US007423530B2

(12) United States Patent
Babich et al.

(10) Patent No.: US 7,423,530 B2
(45) Date of Patent: Sep. 9, 2008

(54) CROSS-ZONE SUPERVISION FOR A SECURITY SYSTEM

(75) Inventors: Thomas S. Babich, Glen Cove, NY (US); Christopher D. Martin, Plainview, NY (US); Kevin G. Piel, Ronkonkoma, NY (US)

(73) Assignee: Honeywell International Inc., Morristown, NJ (US)

( * ) Notice: Subject to any disclaimer, the term of this patent is extended or adjusted under 35 U.S.C. 154(b) by 227 days.

(21) Appl. No.: 11/233,105

(22) Filed: Sep. 22, 2005

(65) Prior Publication Data

US 2007/0063841 A1 Mar. 22, 2007

(51) Int. Cl.
*G08B 13/08* (2006.01)

(52) U.S. Cl. ..... 340/545.1; 340/501; 340/522

(58) Field of Classification Search ..... 340/501, 340/507, 514, 522, 526, 545.1
See application file for complete search history.

(56) References Cited

U.S. PATENT DOCUMENTS 4,195,286 A * 3/1980 Galvin ..... 340/501
4,625,199 A * 11/1986 Pantus ..... 340/522
4,833,450 A * 5/1989 Buccola et al. ..... 340/506
RE33,824 E * 2/1992 Johnson ..... 340/522
6,137,402 A * 10/2000 Marino ..... 340/506
2003/0128125 A1* 7/2003 Burbank et al. ..... 340/605
2006/0192666 A1* 8/2006 Parker et al. ..... 340/507
2006/0226971 A1* 10/2006 Petricoin et al. ..... 340/517
2007/0008411 A1* 1/2007 Shibata et al. ..... 348/152

FOREIGN PATENT DOCUMENTS

WO WO 99/66467 A1 12/1999

* cited by examiner

*Primary Examiner*—Jeff Hofsass
*Assistant Examiner*—Edny Labbees
(74) *Attorney, Agent, or Firm*—Scully, Scott, Murphy, Presser, P.C.

(57) ABSTRACT

An error condition, fault, defect, obstruction, or defective arrangement of viewing angle is determined in a target security device, such as a motion sensor. A plurality of times a fault is detected in a first security device arranged to sense activity in a first zone, the target security device being arranged to sense activity in a second zone overlapping with the first zone; and the error condition may be determined in the target security device when fault in the target security device is not detected for the plurality of times. The second zone may overlap substantially all of the first zone. The first security device may be a door security sensor, a gate security sensor, a keypad or a motion detector. When the first security device is a keypad or user interface, the fault may be an arm or disarm command or an arm/disarm command cycle.

19 Claims, 6 Drawing Sheets

CROSS-ZONE SUPERVISION FOR A SECURITY SYSTEM

FIELD OF THE INVENTION

This invention relates generally to the field of security systems, and in particular to security device error, defect, obstruction, and malfunctioning sensor orientation monitoring and cross-zone supervision and control of security systems.

BACKGROUND OF THE INVENTION

Security systems offer a degree of security for residential sites and for office, business, or industrial applications. Typically, a security device monitoring or controlling a zone is provided as part of a security system. For example, an alarm may be set, which is triggered upon the occurrence of various threat or alarm conditions. At a larger installation, such as in a business, industrial or office setting, more than one zone and security device may be provided at various locations of the site. The security devices are typically connected to a security control panel, which is essentially a control board or control module for security for the site. Also, a remote central monitoring station may be connected, and this central station may be notified when fault, a threat condition, or some other type of security breach, a fire condition, or other type of emergency condition or the like is detected.

In such conventional systems, the problem exists that a security device, such as a motion sensor detector may not be working properly because of a defect. For example, a motion detector or sensor using a pyro element that detects infrared light may get less sensitive over time as the device ages, because the lenses deteriorate and electronics and wires fail. Humidity or moisture can exacerbate the effects of oxidation or aging in wires and electronic devices, as can dust, termites or rodents.

Another problem is that the view of the sensor, such as a motion detector or other sensor that is arranged to sense a disruption in infrared light, microwaves, or other types of electromagnetic radiation may be blocked by objects that are inadvertently placed in its field of view, or the angle at which the sensor is deployed may become disadvantageously changed as a result of the nearby movement of people or objects, or because of the effect of gravity, drafts, or the loosening over time of screws or fasteners used to fasten the sensor to a wall, ceiling or the like. For example, an angle at which a passive IR sensor or dual technology apparatus is deployed in a corner of a room near the ceiling may slowly change because of the effect of gravity on one or more fasteners that fasten the apparatus to the wall or ceiling.

Further, in preparation for a crime or intrusion, or other undesirable occurrence, the view of the sensor may be deliberately blocked or obstructed or the field of view of the sensor may be deliberately changed. As a result, the intended view of a motion detector would no longer correspond to the actual view.

It would be desirable therefore, if such change in view, defect, or obstruction could be detected and reported to a central node or central station.

Another problem is that there may be a redundancy of sensors at a site because of alarm verification, requiring both sensors to be tripped before an event is triggered, which could result in a false sense of security when one or more of the sensors is defective or the field of view is off the mark.

BRIEF SUMMARY OF THE INVENTION

A method and apparatus for determining an error condition in a target security device are provided. The method includes detecting a fault or alarm condition or the like a plurality of times in a first security device arranged to sense activity in a first zone, the target security device being arranged to sense activity in a second zone overlapping with the first zone; and determining the error condition in the target security device when a fault in the target security device is not detected for the plurality of times.

The second zone may overlap substantially all of the first zone.

The target security device and the first security device may be motion detectors. The first security device may also be a door security sensor or a gate security sensor. When the first security device is a keypad or user interface, the fault may be an arm setting, a disarm setting, and/or an arm/disarm cycle at the keypad or user interface.

Further, the plurality of times may be a pre-specified number greater than 3 and less than 30 of most recent consecutive alarm conditions of the first security device. The error condition can be determined as follows: the fault in the first security device may be detected the plurality of times over a period of time longer than a pre-specified time period.

When the error condition is determined, a signal may be transmitted to a central station. Also, the error condition may be confirmed by detecting fault in a third security device the plurality of times, the third security device being arranged to sense activity in a third zone overlapped by the second zone. Then, a signal may be transmitted to the central station when the error condition is confirmed or may be transmitted only when it is confirmed.

DETAILED DESCRIPTION OF THE INVENTION

The following discussion describes embodiments of Applicant's invention as best understood presently by the inventors, however, it will be appreciated that numerous modifications of the invention are possible and that the invention may be embodied in other forms and practiced in other ways without departing from the spirit of the invention. Further, features of embodiments described may be omitted, combined selectively or as a whole with other embodiments, or used to replace features of other embodiments, or parts thereof, without departing from the spirit of the invention. The figures and the detailed description are therefore to be considered as an illustrative explanation of aspects of the invention, but should not be construed to limit the scope of the invention. The scope of the invention is defined by the below-set forth claims.

Aspects of the invention will be described with reference to FIG. 6, which is a schematic diagram of a security control node according to an embodiment of the present invention. For example, a control panel or central board at a site may embody or perform the functions of the security control node 60, or may be connected via a wired or wireless connection to one or more devices performing the functions of the security control node 60. Alternative, the functions of the security control node 60 may be performed off-premises, such as by a server or node at a central station.

Figure 6:
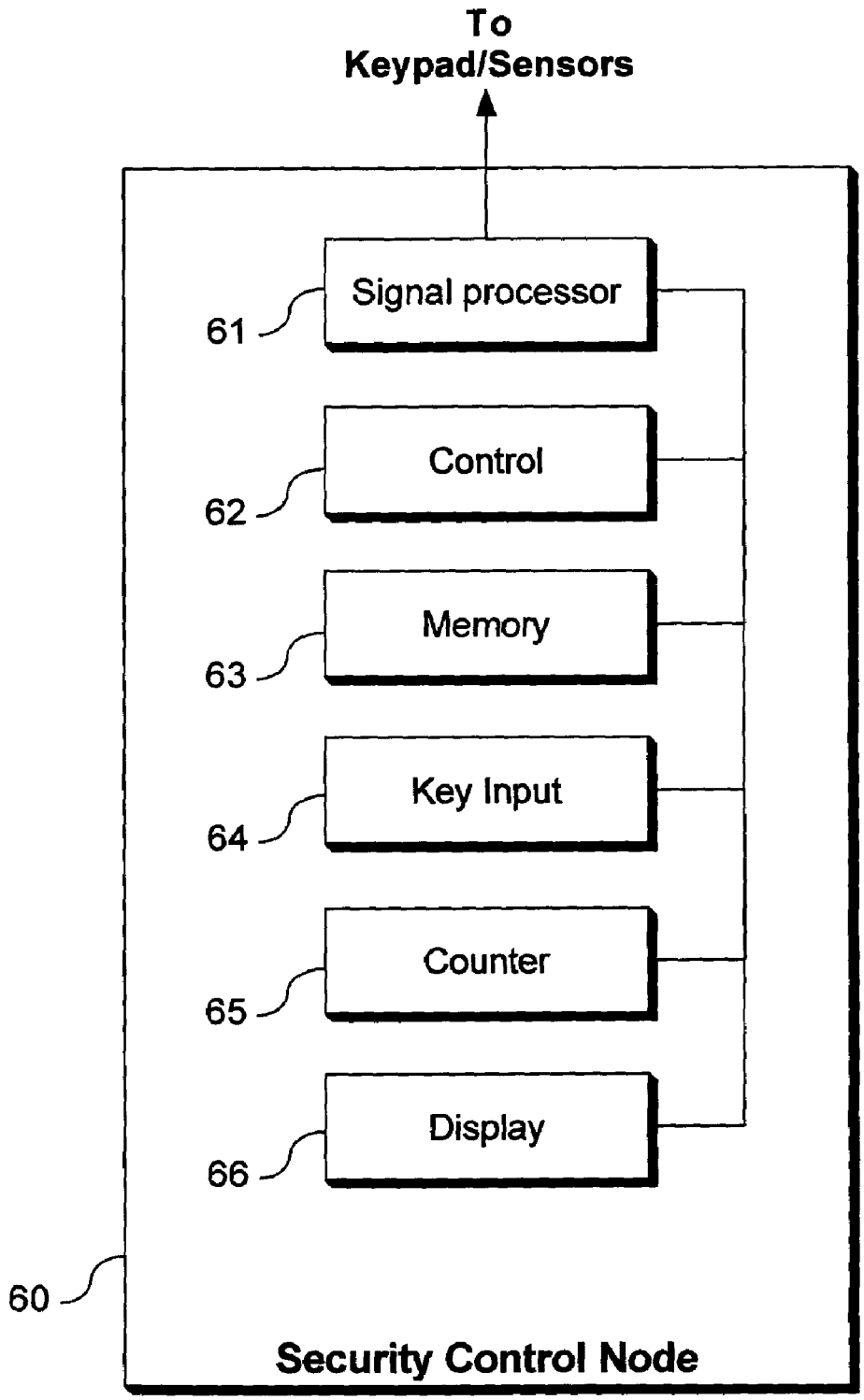
FIG. 6 is schematic diagram of a security control node according to an aspect of the present invention.

The security control node 60, as shown in FIG. 6, may be comprised of a control panel for a house, site, or application, and thus connected by a wired or wireless connection to each of the keypads that control individual zones of the site and/or to each of the sensors, including motion detectors and sensors, door, window or gate sensors, fire, smoke carbon monoxide detectors or the like, in each zone. Security control node 60 may include a signal processor 61, that receives and transmits electrical or radio signals to the sensors and control devices of the various zones. Signal processor 61 may connect to a data network embodying a security system via a wired or a wireless connection. For example, a keypad or security device of the system may be connected to an Ethernet or to another type of LAN (local area network), or to another network capable of transmitting data, such as an IP network. A memory 63 stores information and settings about the node and the system. For example, memory 63 may store information about whether a fault or alarm condition has occurred in a particular zone. Key input 64 is used to input commands to security control node 60, and to request reports or information from security control node 60. Key input 64 may include keys, knobs, buttons, electronic scroll pads, track pads, or the like. The key input 64 may also include or be embodied as a full size keyboard, or as a mobile keypad that may be attached to and detached from the user interface as necessary by the user.

Reports or information may be provided by security control node 60 using display 66. A fault may comprise the tripping of an alarm, the triggering of an alarm condition, including an opening or breaking of a window, door, gate, lock or the like, a detected motion, an interaction by a user at a keypad or user interface, including for example, an attempted entry or the providing of an incorrect PIN or code, a broken wire, or any other such condition. For example, whether or not the security system is armed, faults can be detected. By way of illustration, a user at keypad may interact with the system causing a fault, or a motion sensor can detect motion and register a fault, even if the security system is not armed. Counter 65 may be used to keep track of a number of times that a fault or alarm condition has been detected in one or more zones. The control 62 coordinates the functioning of the units or modules of the security control node 60. Control 62 may include an integrated circuit, such as a chip to execute software modules for the functioning of the keypad as described herein. Control 62 and the modules of the security control node 60 may be configured as hardware, software, firmware, or some combination of the foregoing.

An operation of a system according to the present invention will now be described with reference to FIGS. 1-6.

Figure 1:
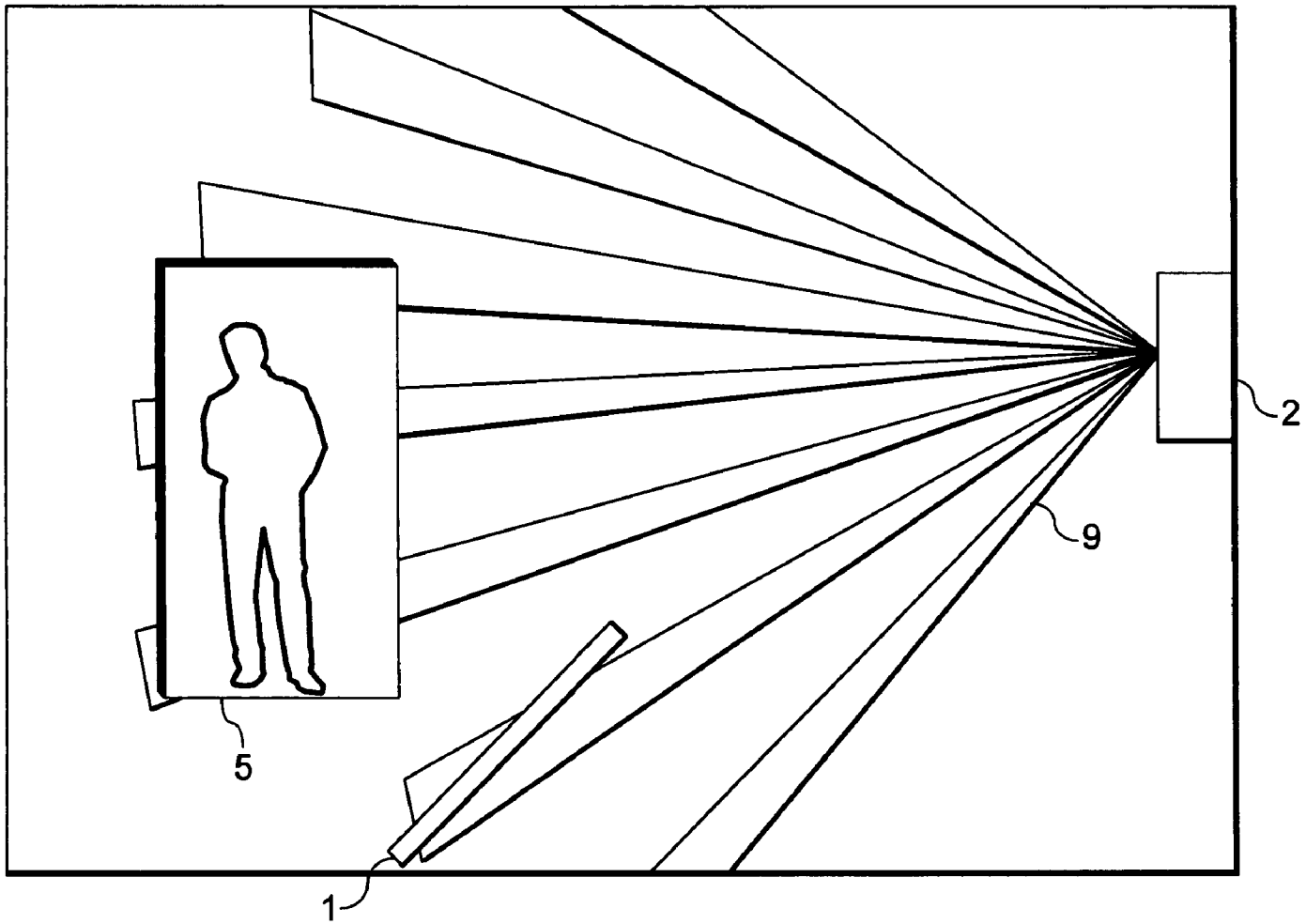
FIG. 1 illustrates a motion sensor covering a zone that includes a zone corresponding to a door.
Figure 2:
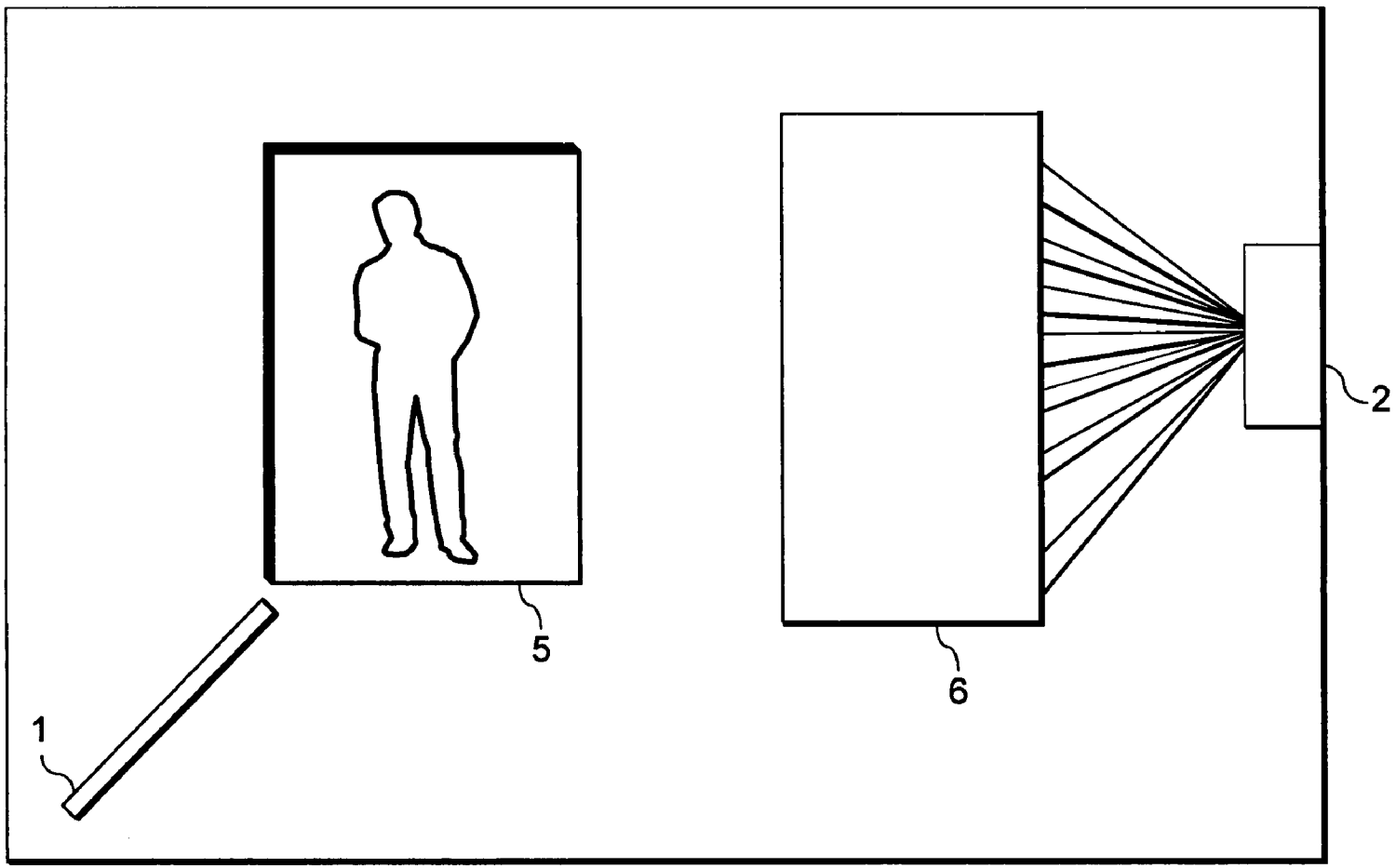
FIG. 2 illustrates a blockage of a field of view of a motion sensor.
Figure 3:
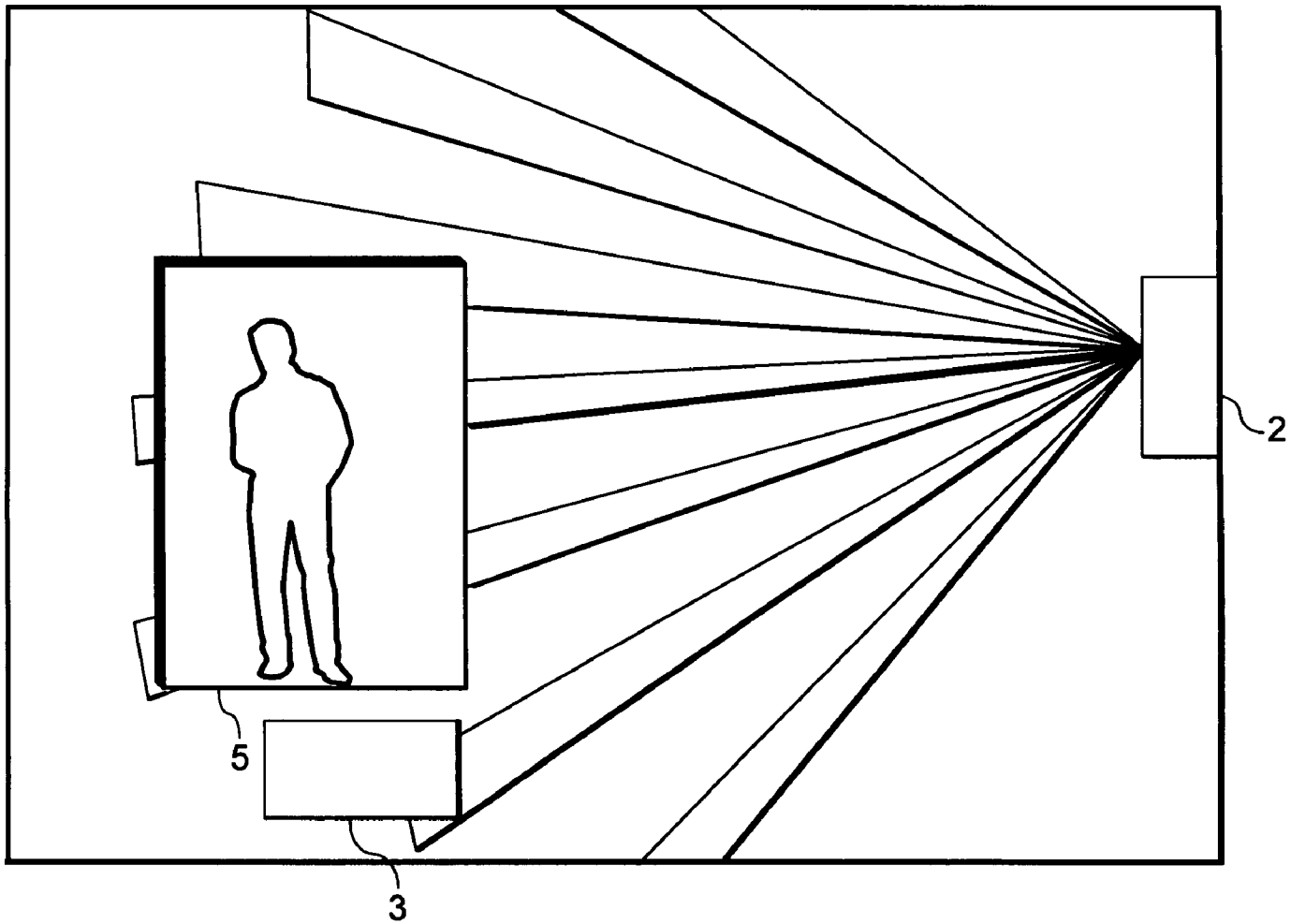
FIG. 3 illustrates a motion sensor covering a zone that includes a first zone covered by a security apparatus for a door.

A fault is detected at a first security device 1, as illustrated in FIGS. 1-4. A person 5 may open a door 1 monitored by security device 1, registering a fault in security device 1. FIGS. 1 and 2 illustrate a person 5 entering a door 1 to trigger a sensor in security device 1. FIG. 3 shows the person 5 interacting with a keypad/user interface 3 at the door, for example entering a security code in an attempt to gain entry via the door. The security device at a door or gate may be a keypad or other type of user interface used to gain entry. In such a case, the system may monitor the number of arm and/or disarm commands or the number of arm/disarm cycles during which the target security device detects no alarm condition or fault. Accordingly, a "fault" or an alarm condition as those terms are used herein at security device 1 in such a configuration may be the arm/disarm command or the arm/disarm cycle, such that the error condition for the target security device is determined when no fault is detected at the security device for a predetermined number of arm/disarm commands or the arm/disarm cycles.

Figure 4:
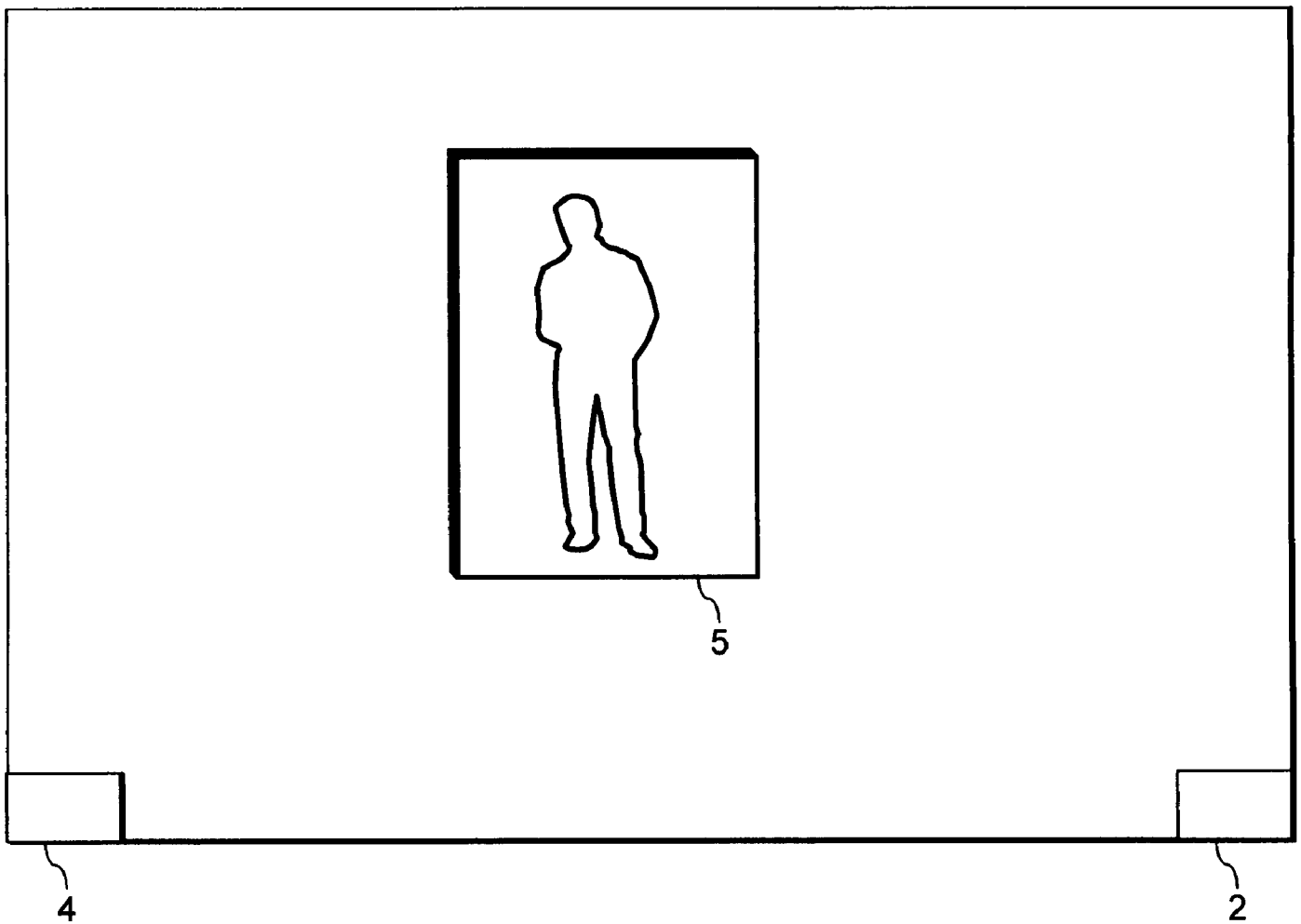
FIG. 4 illustrates a motion sensor in the second motion sensor that cover overlapping zones.

FIG. 4 illustrates the person 5 triggering motion sensor 4 by his movement or presence. The fault is signaled to the security control node 60 by the alarm/security system or network to signal processor 61 of the security control node 60, as shown at S1 of FIG. 5. Alternatively, the fault may be signaled to a control panel or some central node (not shown), which may then signal the security control node 60.

Figure 5:
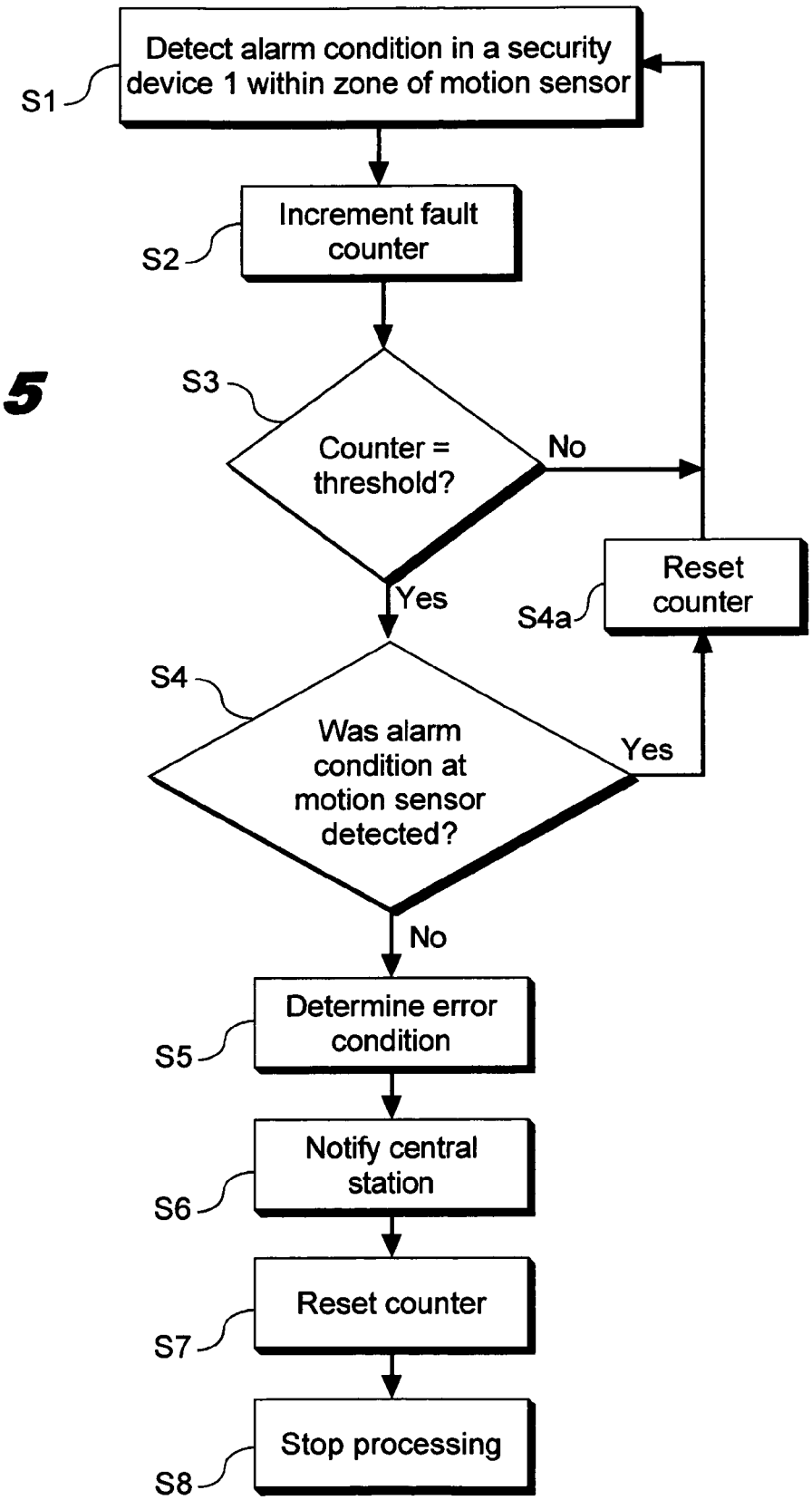
FIG. 5 is a flowchart illustrating an operation of a system according to an aspect of the present invention.

The security control node 60 increments a counter 65, as shown at S2 of FIG. 5. As described herein, the counter 65 is incremented each time the condition or fault is detected at that first security device. At this time, a timer (not shown) may also be started to keep track of the first instance of the fault.

At S3, the value in counter 65 is compared to a previously set threshold value to determine whether the number of faults detected at security device 1 equals the pre-specified threshold value. If the number of faults detected thus far does not equal the pre-specified threshold value, the "No" branch at S3, processing is returned to S1 where the security control node 60 continues to monitor faults occurring at security device 1.

If however the number of faults detected at security device 1 equals the threshold value, "Yes" branch at S3, then it is determined whether a fault has been detected for motion sensor 2, the target motion sensor whose functioning is being verified, during the pre-specified number of faults at security device 1. If fault has been detected for motion sensor 2 during the detection of these faults at security device 1, "Yes" branch at S4, then processing moves to S4*a*, where the counter is reset and then to S1, where monitoring of alarm conditions at security device 1 is continued.

If on the other hand, no alarm condition is detected at motion sensor 2 during the detection of the faults at security device 1, "No" branch at S4, then processing continues to S5, where an error condition for motion sensor 2 is determined, since motion sensor 2 appears to be functioning defectively.

For example, as shown in FIG. 1 a person 5 has entered door 1 monitored by security device (not shown) triggering fault in security device 1. Motion sensor 2 is arranged to monitor zone 9. However, motion sensor may be defective due to a failed battery, age, oxidized wires, poor design, or other conditions, or may be positioned inappropriately or its view blocked. Further, a fault in the wiring connecting motion sensor 2 to security control node 60 may have occurred. Thus, notwithstanding repeated triggering of the alarm condition at door 1, security control node 60 detects no alarm condition at motion sensor 2. Also, as shown in FIG. 3, a person 5 or more than one person over the course of time may repeatedly interact with keypad/user interface 3, but because of one or more defects in or defective positioning of motion sensor 2, no alarm condition is detected from motion sensor 2. FIG. 4 shows a motion sensor 4 that detects a motion or presence of a person 5 in its zone, which is overlapped by the zone of motion sensor 2. Motion sensor 4 sends signals indicating a fault or alarm condition to security control node 60, but because of the defect, no alarm condition is detected at motion sensor 2.

Similarly, as shown in FIG. 2, a person 5 using a door 1, triggering fault at a security device monitoring the zone corresponding to door 1. Obstructing object 6 obstructs the view of motion sensor 2, resulting in motion sensor 2 failing to properly monitor activity in its zone.

According to an aspect of the present invention, when a zone monitored by the target security device is bypassed (for example, when an arm setting is set for the security system but an arm setting is not set for that zone), the system would not determine an error condition for the target security device when no fault is detected from the target security device. Accordingly, since for the duration of the disarm condition of the target security device no fault signal could be received by the control panel or the security control node 60, no fault signal would be expected. Similarly, if the control panel cannot "see" the target security device on the bus because of some defect on the cross-zoned keypad, no fault signal from the target security device would be expected and therefore an error condition would not be determined.

After the error condition in motion sensor 2 is determined at S5, a central station may be notified at S6. Alternatively, a user (not shown) may be directly notified of the error condition determined. Display 66 may identify motion sensor 2 as being defective.

In this way, the defect of the motion sensor 2 (or wires connecting thereto), or defective functioning of the motion sensor 2 may be detected. Further, in an embodiment in which motion sensor 2 is connected to the security system or to the security control node 60 via a wireless connection, a problem in transmission by motion sensor 2 may be detected. Similarly, in embodiment in which motion sensor 2 is connected to security system or to the security control node 60 via a network involving one or more other elements or nodes, a problem in the network or other elements or nodes may be detected. In this way, a cross-zone supervision approach is performed, such that the proper functioning of the motion sensor is monitored or supervised by another security device having an overlapping security zone.

According to an aspect of the present invention, a third security device is deployed to monitor the zone overlapped by zone 9 monitored by the motion sensor 2. Thus, the third security device may be used to confirm the error condition in motion sensor 2. Accordingly, if the error condition is determined at S5, the error condition would be confirmed if a fault was triggered in the third security device at least once. The problem in security device 2 may be reported to a user or the central station.

At S7, the counter 65 of security control node 60 is reset in order to prepare for the next round of monitoring of the motion sensor 2. It will be understood that security control node 60 may include more than one node such as counter 65, to monitor motion sensors in other zones using other security devices.

Processing is stopped at S8, until a further fault of alarm condition in security device 1 is detected at S1.

Preferred embodiments and methods of the present invention discussed in the foregoing are to be understood as descriptions for illustrative purposes only, and it will be appreciated that numerous changes, substitutions, omissions, and updates thereof are possible without departing from the spirit and scope of the claims.

What is claimed is:

1. A method of determining an error condition in a target security device, the method comprising:

detecting a fault a plurality of times by a first security device arranged to sense activity in a first zone, the target security device being arranged to sense activity in a second zone overlapping with the first zone, the first security device and the target security device are remotely located from each other and in a separate housing; and determining the error condition in the target security device when the target security device signals no fault for the plurality of times.

2. The method of claim 1, wherein the second zone overlaps substantially all of the first zone.

3. The method of claim 1, wherein the target security device is a motion detector.

4. The method of claim 1, wherein the first security device is a motion detector.

5. The method of claim 1, wherein the first security device is one of a door security sensor and a gate security sensor.

6. The method of claim 1, wherein the first security device is at least one of a keypad and a user interface.

7. The method of claim 1, wherein the plurality of times is a pre-specified number greater than 3 and less than 30 of most recent consecutive faults of the first security device.

8. The method of claim 1, said determining the error condition comprises detecting the fault in the first security device the plurality of times over a period of time longer than a pre-specified time period.

9. The method of claim 1, comprising transmitting a signal to a central station when the error condition is determined.

10. The method of claim 1, comprising confirming the error condition by detecting a fault in a third security device the plurality of times, the third security device being arranged to sense activity in a third zone overlapped by the second zone; and transmitting a signal to a central station when the error condition is confirmed.

11. The method of claim 1, wherein the fault comprises at least one of an arm setting, a disarm setting, and an arm/disarm cycle at a keypad, the first security device comprising the keypad.

12. A security control system configured to determine an error condition in a target security device, the device comprising:

a signal processor configured to detect triggering a fault a plurality of times in a first security device arranged to sense activity in a first zone, the target security device being arranged to sense activity in a second zone overlapping with substantially all of the first zone, the first security device and the target security device are remotely located from each other in a separate housing; and a controller configured to determine the error condition in the target security device when a fault in the target security device is not detected for the plurality of times.

13. The system of claim 12, wherein the plurality of times is a pre-specified number greater than 3 and less than 30 of most recent consecutive faults of the first security device.

14. The system of claim 12, wherein said controller determines the error condition by detecting the fault in the first security device the plurality of times over a period of time longer than a pre-specified time period.

15. The system of claim 12, wherein the target security device is a motion detector.

16. The system of claim 12, wherein the first security device is a motion detector.

17. The system of claim 12, wherein the first security device is one of a door security sensor and a gate security sensor.

18. The system of claim 12, wherein the first security device is at least one of a keypad and a user interface.

19. The system of claim 12, wherein the first security device is at least one of a keypad and a user interface, and the fault comprises at least one of an arm setting, a disarm setting, and an arm/disarm cycle at the at least one of the keypad and the user interface.

* * * * *